United States Patent [19]

Tsubai et al.

[11] Patent Number: 4,821,057

[45] Date of Patent: Apr. 11, 1989

[54] PROCESS FOR IMAGE TRANSFER AND EQUIPMENT THEREFOR

[75] Inventors: Yasuo Tsubai; Shozi Oka, both of Nagaokakyo, Japan

[73] Assignee: Mitsubishi Paper Mills, Ltd., Tokyo, Japan

[21] Appl. No.: 892,369

[22] Filed: Aug. 4, 1986

[30] Foreign Application Priority Data

Aug. 6, 1985 [JP] Japan ..... 60-173754
Aug. 6, 1985 [JP] Japan ..... 60-173755
Aug. 6, 1985 [JP] Japan ..... 60-173756

[51] Int. Cl.[4] ..... G03D 9/00
[52] U.S. Cl. ..... 354/301; 354/338
[58] Field of Search ..... 354/301, 302, 303, 305, 354/338, 339

[56] References Cited

U.S. PATENT DOCUMENTS 2,786,401 3/1957 Briggs et al. ..... 354/301
3,062,124 11/1962 Lassig ..... 354/302
3,136,238 6/1964 Corona ..... 354/302
4,334,757 6/1982 Byers ..... 354/301
4,643,962 2/1987 Tsubai et al. .

FOREIGN PATENT DOCUMENTS 1125768 3/1962 Fed. Rep. of Germany ..... 354/301
58-65044 5/1983 Japan .
713729 8/1954 United Kingdom ..... 354/302
1037051 7/1966 United Kingdom ..... 354/301

*Primary Examiner*—A. A. Mathews
*Attorney, Agent, or Firm*—Cushman, Darby & Cushman

[57] ABSTRACT

Disclosed is a process for image transfer from an image donating sheet to an image receiving sheet by treating these sheets in equipment or apparatus provided with a parting member, a processing tank and a pair of squeegee rolls which comprises introducing into the processing solution in the processing solution tank the image donating sheet and the image receiving sheet which are bonded together along one edge and between which the parting member is held.

8 Claims, 3 Drawing Sheets

PROCESS FOR IMAGE TRANSFER AND EQUIPMENT THEREFOR

BACKGROUND OF THE INVENTION

This invention relates to a process for image transfer by introducing an image donating sheet and an image receiving sheet into a processing solution and pressing together both sheets; it relates also to equipment or apparatus to carry out the process.

There are well-known processes for the transfer of an image from one sheet to another. In a typical example of such processes, silver compounds or dyes are transferred imagewise from a photosensitive sheet bearing a silver halide emulsion layer to an image-receiving sheet to form thereon a silver image or a colored dye image. In another example, as described in Japanese Patent Application No. 49,640/85, an exposed photosensitive sheet is subjected to etching-bleaching, then the remaining gelatin layer is colored with a desired dye, and the colored sheet is allowed to contact closely with any other sheet to transfer the dye image to the latter sheet. The transferred dye image can be further transferred to another image-receiving sheet. Hereinafter, a sheet from which an image is transferred is referred to as an image donating sheet N and a sheet to which an image is transferred is referred to as an image receiving sheet P.

In carrying out the image transfer two sheets are brought into face-to-face superposition, both sheets are introduced into a processing bath while being held apart and guided by means of a parting plate, then both sheets are pressed together by a squeegeeing roll which removes the excess processing solution, and the sheets are peeled apart after the image transfer has been completed under atmospheric conditions. This process is used widely, because it needs only a simple processor.

A principal difficulty encountered with a conventional processor is that of keeping both sheets precisely in relative position, i.e. in both the direction of movement and the transverse direction. High precision is required in positioning the sheets when a multi-color image is formed by the overlay of multiple image receiving sheets each carrying a transferred colored dye image. It would be very useful, therefore, if the requirement could be met using a simple processor.

SUMMARY OF THE INVENTION

Primary objects of this invention are to provide a process and an apparatus whereby an image donating sheet and an image receiving sheet are kept in precise relative position.

DESCRIPTION OF THE INVENTION

The above objects of this invention have been achieved by the process of image transfer by treating an image donating sheet and an image receiving sheet in an apparatus (processor) provided with a parting member, a processing tank and a pair of squeegee rolls, which is based on the fundamental design idea that the above sheets which are introduced into the processing solution in the processing tank, are bonded together along one edge and are separated by a parting member.

Figure 2:
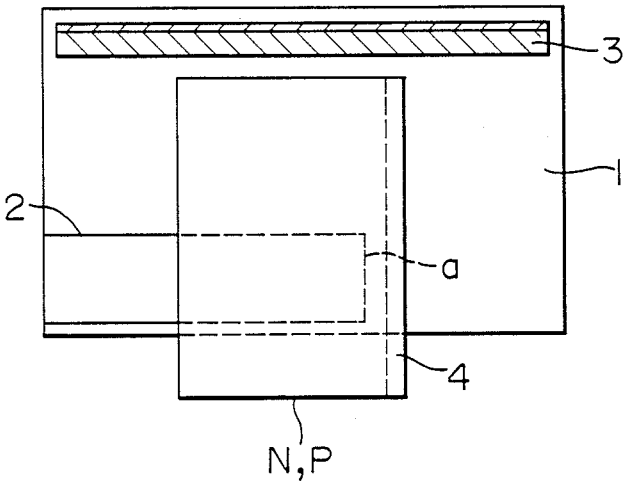
FIGS. 2 to 4 are schematic drawings representing other embodiments of the present image transfer process.
Figure 3:
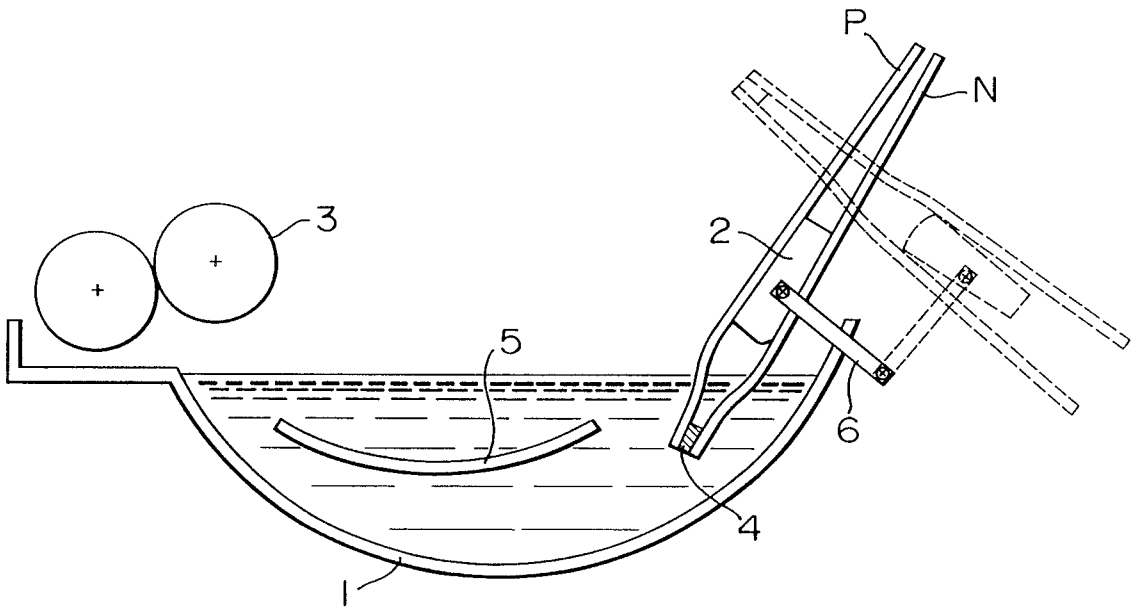
Figure 4:
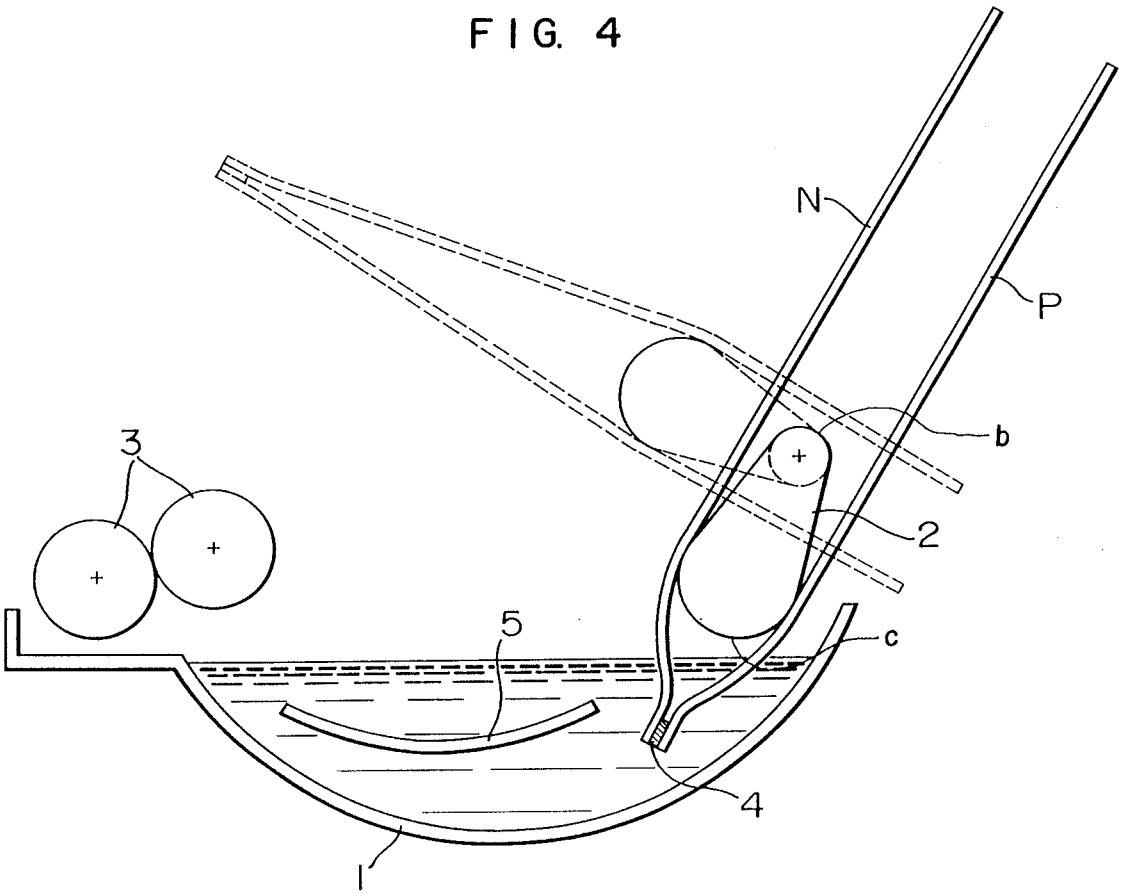

This invention as outlined above can be developed into various embodiments as shown in FIGS. 2–4.

For example, when one side of the parting member is attached to the frame member of the processing tank and the opposite side is free, the two sheets may be bonded together along either the front or side edge relative to the processing tank (See FIG. 2).

Furthermore, when the parting member is designed so that it may be shifted to a position outside the processing tank or shifted at variable angles relative to the processing tank (as in FIGS. 3 and 4), one side of the parting member may be attached and another side may be unattached or free or both ends may be attached. When both sides of the parting member are attached, the two sheets are bonded together along only the front edge, which first reaches the processing solution, and the parting member which has been shifted to a position outside the processing tank is put between the two sheets (to prevent the sheet from becoming wet with the processing solution).

Further, the present invention includes a convenient processor or apparatus (processing equipment) suitable for carrying out the present process. A detailed description of the processor is given hereunder.

The invention is illustrated in detail hereunder with reference to Examples and accompanying drawings in order to facilitate the understanding of the present invention.

EXAMPLE 1

Figure 1:
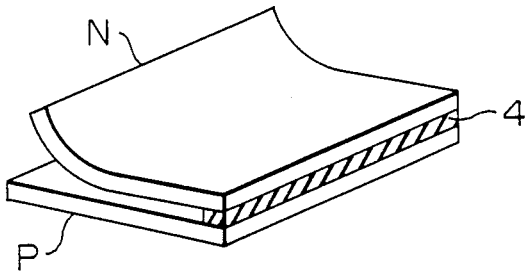
FIG. 1 presents a perspective view of an example, showing the bonding of two sheets.

FIG. 1 is a perspective view representing the manner of bonding together the image donating and image receiving sheets along one edge of each sheet. FIG. 2 is a schematic drawing of a processor in operation to process the bonded sheets of FIG. 1, said schematic view being exaggerated for the purpose of illustration.

At first, an image donating sheet N and an image receiving sheet P are bonded together along one edge of each sheet as shown in FIG. 1. The bonding is performed, for example, by using either an adhesive piece 4 such as a piece of duplex double-sided adhesive tape or an adhesive paste. Although the manner of bonding as shown in FIG. 1 is favorable for securing precise registration, it is possible to arrange both sheets in superposition and bond both sheets by means of various adhesives or a one-sided adhesive tape such as "Cellotape".

In bonding two sheets, the length of the edges of each of two shees to be bonded need not be the same as long as the proper registration is secured. When two rectangular sheets are to be bonded together, either the longer edge or the shorter edge of each sheet can be bonded together.

The bonded sheets are processed in a processor with the bonded edge at the front or at the side. As shown in FIG. 2, the processor is characterized by being provided with a parting member 2 attached on one side and unattached or free on the other side (a) to allow the parting member 2 to intervene between the two sheets with the bonded edge at one side. The sheets are processed while holding the parting member 2 between them until the squeegee rolls 3 are reached. In another procedure, the bonded sheets are introduced into the processing solution with the bonded edge (rectangular sheets are generally bonded along the shorter edge) at the front after the sheets have been moved or while the sheets are being moved to have the parting member 2 held between them. The two sheets can, of course, be bonded together along both the front edge and one side edge without causing any problem with the intervention of the parting member.

The parting member 2 is mounted in an inclined position so that a portion or all of it will not be immersed in the processing solution. The latter type is preferred when the bonded sheets are processed with the bonded edge at the front. The thickness of parting member is generally in the range from about 1 to about 10 mm, though not limited to this size. The thickness can be further increased when it is difficult to uniformly fill the gap between the sheets with processing solution. For the purpose of smooth running of the bonded sheets, it is desirable to use a parting member provided with grooves or ridges parallel to the direction of the movement of sheets (e.g. corrugated board) or to use a rod-like assembly as disclosed in Japanese Utility Model Application "Kokai" (Laid-open) No. 65,044/83.

One side of the parting member 2 is supported fixedly or removably by the wall of processing tank, while the opposite side (a) is free of support. The length of parting member 2 from the supported side to the free side is any length desired so long as the parting member serves its purpose.

The processor can be provided with two parting members, an upper one and a lower one. In this case, two image donating sheets and one interposed image receiving sheet are bonded together and processed to transfer images to both sides of the receiving sheet.

A conventional guide plate supported at both ends can be provided above and/or below the parting member 2. The material of parting member 2 is preferably a type of plastic, metal, or rubber.

The processor suitable for use in carrying out the present process has an advantage in that it can be used in processing not only the bonded sheets but also unbonded image donating and image receiving sheets to perform conventional image transfer.

The squeegee rolls 3 are operated by a motor not shown in the drawings. The processor includes other known means and functions such as, for example, a guide plate in the processing solution, a mechanism for the control of solution temperature and a reservoir for squeegeed solution.

The supports used for the image donating sheets N and image receiving sheets P include a variety of materials such as paper supports (e.g. resin-coated paper), film supports, metal supports, or supports of these materials in composite form. The processing solutions include common alkaline image transfer solutions, and acidic transfer solutions for use in the transfer of colored dye images.

EXAMPLE 2

FIG. 3 is a schematic cross-sectional view in exaggerated form to facilitate the understanding of a processor which can treat the bonded image donating and the image receiving sheets shown in FIG. 1. The notations N and P in FIG. 3 stand for an image donating sheet N and an image receiving sheet P, respectively, described in Example 1. The bonding of both sheets is performed at their front or side edges relative to the processing solution.

The bonded sheets are held as shown in broken lines in FIG. 3 by the following procedure. The parting member 2 is moved by means of a movable supporting member 6 to the position shown in broken lines. The bonded sheets are moved so that the parting member 2 may be inserted through the unbonded portion opposite to the bonded edge and the sheets are held by grasping the unbonded edge by hand. Such a procedure keeps the sheets from wetting with the processing solution. The parting member 2 together with the bonded sheets is then moved to the position shown in solid lines to allow the sheets to move toward the squeegee rolls 3.

From the above description, it will be understood that according to this invention, before being introduced into the processing solution, the two sheets bonded along one edge of each sheet are kept from unintentional wetting with the processing solution, or from sticking together, and from non-uniform image transfer, whereby satisfactory image transfer results from the simple procedure.

To hold the parting member 2 in the positions shown in solid lines and in broken lines, it is desirable to provide a stopper to check the downward movement of the supporting member 6. If necessary, the parting member 2 can be kept in a position where it is partially immersed in the processing solution. The supporting member 6 is preferably disposed so that it can pivotally move parting member 2 at or rear at least one wall of the processing tank on the inner or outer side of the wall.

The movement of the parting member 2 can be controlled either manually or automatically.

For the purpose of smooth running of the bonded sheets, it is desirable to use a parting member provided with grooves or ridges parallel to the direction of movement of the sheets (e.g. corrugated board) or to use a rod-like assembly as disclosed in Japanese Utility Model Application "Kokai" (Laid-open) No. 65,044/83. Since the sheets are bonded along one edge, the leading edge of the parting member 2 (the edge nearer to the processing solution tank) is preferably about 5 to about 30 mm in thickness in order to allow the processing solution to more easily fill the gap between the sheets.

The material of the parting member 2 is preferably comprised of a type of plastic but can be comprised of other materials such as a type of method or rubber. The processor suitable for use in carrying out the process of this invention has an advantage such that it can be used in processing not only the bonded sheets but also unbonded image donating and image receiving sheets to perform conventional image transfer.

The squeegee rolls 3 are operated by a motor (not shown). The processor includes other known means and functions such as, for example, a guide plate 5 in the processing solution, a mechanism for the control of solution temperature, and a reservoir for squeegeed solution.

The supports used in the image donating sheets N and image receiving sheets P include a variety of materials such as paper supports (e.g. resin coated paper), film supports, metal supports, or supports of these materials in composite form.

EXAMPLE 3

An image donating sheet and an image receiving sheet used in the present Example are bonded together by the same procedure as in Example 2.

The bonded sheets are held in the position shown in broken lines in FIG. 4 by the following procedure. The parting member 2 of the processor is slanted upward from the back edge bs to the front edge c by manipulating an external shifting member (not shown). The bonded sheets are moved so as to insert the parting member 2 therebetween through the unbonded edges of the sheets. The bonded sheets are held in place by holding with the fingers the free ends of the sheets opposite to the bonded edge. The parting member 2 is then turned by means of the external shifting member so that the bonded sheets may enter the processing solution and can be guided to reach the squeegee rolls 3.

From the above description, it will be understood that according to this invention, before being introduced into the processing solution, the two sheets bonded along one edge of each sheet are kept from unintentional wetting with the processing solution, from sticking together, and from non-uniform image transfer, whereby satisfactory image transfer results from the simple procedure.

The parting member 2 is disposed above the surface of processing solution so as not to become wet with the solution. It is supported by the wall of the processor. The angle relative to the processing solution tank can be varied by an external shifting member. The front edge of the parting member is thicker than the rear edge. The parting member is preferably disposed near the surface of processing solution. In such a way, the sticking of both sheets, which hinders partially or entirely the entering of processing solution between the sheets, can be avoided. Although it depends upon the type and stiffness of the sheets, the thickness of the back and front ends of the parting member each range from about 5 to about 30 mm. The distance between the surface of processing solution and the parting member is also about 5 to about 30 mm. As shown in FIG. 4, the front edge is made thicker than the rear edge to allow the bonded sheets to enter the processing solution while being kept apart by the parting member 2. The width (i.e. the distance between the front edge c and the rear edge b) of the parting member is preferably about 3 to about 10 cm.

The angle (inclination) of the parting member 2 is not necessarily made variable by the external lever shifting member. It can be disposed by means of a supporting axis so that it may freely move around the axis to a position where the center of gravity is to be more toward the front end c or more toward the rear end b. To control the distance between the front of the parting member and the processing solution, the parting member is held in inclined position shown in solid lines in FIG. 4 by means of a stopper attached to the inner wall of the processor).

The material of parting member 2 is preferably comprised of a type of plastic but can be other materials such as metals or rubber.

The processor suitable for use in carrying out the present process has an advantage in that it can be used in processing not only the bonded sheets but also unbonded image donating and image receiving sheets. The squeegee rolls 3 are operated by a motor (not shown). The processor includes other known means and functions such as, for example, a guide plate 5 in the processing solution, a mechanism for the control of solution temperature, and a reservoir for squeegeed solution.

The supports used in the image donating sheets and image receiving sheets include a variety of materials such as paper supports (e.g. resin-coated paper), film supports, metal supports, or supports of these materials in composite form. The processing solutions include common alkaline image transfer solution, the acidic transfer solutions for use in the transfer of colored dye images.

According to this invention, it is possible to perform image transfer with satisfactory alignment of the image donating and image receiving sheets using a simple processor.

What is claimed is:

1. A processor for image transfer comprising a parting member, for parting an image donating sheet and an image receiving sheet, a processing solution tank and a pair of squeegee rolls wherein one side of the parting member is attached to the inner side wall of the processing solution tank and another side of the parting member is unattached to another inner side wall of the processing tank, wherein the processor can accommodate the image donating and image receiving sheet that are bonded along a side or front edge relative to a direction they are fed into the processor.

2. A processor for image transfer comprising a parting member, for parting an image donating sheet, and an image receiving sheet a process solution tank, a pair of squeegee rolls and means of a movable supporting member so that said parting member can be shifted to a position inside or outside the tank.

3. A process for image transfer comprising a parting member, for parting an image donating sheet and an image receiving sheet, a processing solution tank, a pair of squeegee rolls and means for shifting said parting member to variable angles relative to the processing solution tank.

4. A process for image transfer from an image donating sheet to an image receiving sheet by use of a processor comprising a parting member, a processing solution tank, and a pair of squeegee rolls, wherein the parting member is attached on one side thereof to the inner or outer wall of the processing solution tank by means of a supporting member and is unattached on the opposite side, said image donating sheet N and image receiving sheet P being introduced into the processing solution tank and moved to the squeegee rolls by means of said parting member wherein the following operations (1)-(3) are repeated:

(1) N and P are set in an original position outside the bank and are bonded together along the front or side edge relative to the processing solution, so that said supporting member holds said parting member between N and P;

(2) N and P with parting member held therebetween are introduced into the processing solution by means of said supporting member; and (3) after completion of the introduction of N and P, said parting member is moved to the original position outside the tank by means of said supporting member.

5. A process for image transfer from an image donating sheet to an image receiving sheet by use of a processor comprising a parting member having a front edge and a back edge, which is attached or unattached on one side and attached on the other side near the outer wall of a processing solution tank by a supporting member wherein said parting member can be turned at various angles relative to the processing tank, the image donating sheet N and image receiving sheet P being introduced in the processing solution tank and moved to squeegee rolls by means of said parting member wherein the following operations (1)-(3) are repeated:

(1) N and P are set in an original position outside the tank and are bonded together along the front or side edge relative to the processing solution, so that said supporting member holds said parting member between N and P, said parting member having a cross section of a shape with greater width along the back edge than along the opposite edge;

(2) N and P are introduced into the processing solution by means of said supporting member with said parting member held therebetween and in such a manner as the space between N and P is expanded by said parting member; and (3) after completion of the introduction into the processing solution, said parting member is turned by means of said supporting member so as to return to the original position away from the surface of the processing solution.

6. A process for image transfer for an image donating sheet to an image receiving sheet by use of a processor comprising one of more parting members which are attached at, at least one end thereof to a processing tank, the image donating sheet N and the image receiving sheet P being introduced into the processing solution tank and led to squeegee rolls by means of one of said parting member wherein (1) N and P are set so that they are bonded together along the front or side edge relative to the processing solution, and if more than one sheet N is used, each sheet N is bonded to an opposite side of P, and the two or more sheets N and P are separated by the parting member or members; and (2) N and P with parting member or members held therebetween are introduced into the processing solution.

7. A process for image transfer according to claim 4, 5 or 6 wherein said sheets are bonded together along the front edge thereof relative to the processing solution tank.

8. A process for image transfer according to claim 4, 5 or 6 wherein said sheets are bonded together along the side edge thereof relative to the processing solution tank.

* * * * *